United States Patent [19]

Dick et al.

[11] 3,934,791

[45] Jan. 27, 1976

[54] CARTON SEALING

[75] Inventors: Raymond S. Dick, Minneapolis, Minn.; David H. Anenson, River Falls, Wis.

[73] Assignee: Hoerner Waldorf Corporation, St. Paul, Minn.

[22] Filed: Nov. 13, 1974

[21] Appl. No.: 523,217

[52] U.S. Cl. ..... 229/37 R; 229/51 WB

[51] Int. Cl.[2] ..... B65D 5/02

[58] Field of Search ..... 229/37 R, 51 WB

[56] References Cited

UNITED STATES PATENTS

| | | | |
|---|---|---|---|
| 1,976,980 | 10/1934 | Bergstein | 229/37 R |
| 2,324,757 | 7/1943 | Botley | 229/37 R |
| 2,996,235 | 8/1961 | Turpin | 229/37 R |
| 3,003,677 | 10/1961 | Hennessey | 229/37 R |
| 3,144,978 | 8/1964 | Asman | 229/37 R |
| 3,197,109 | 7/1965 | Nelson | 229/37 R |
| 3,297,229 | 1/1967 | Blyem | 229/37 R |
| 3,746,244 | 7/1973 | Bergstein | 229/37 R |

*Primary Examiner*—Davis T. Moorhead
*Attorney, Agent, or Firm*—Jerry F. Best

[57] ABSTRACT

Sealed carton closure and method for making same particularly adapted for paperboard cartons having inwardly foldable flaps where the carton is designed to contain material which is subject to sifting or leaking out of the carton. A first end closure flap is folded into position over the entire opening and a band of adhesive is placed across each side of the first flap with the adhesive extending onto the adjacent flaps which are then folded inwardly to create a sealed end with a fourth flap folded on top of the first folded flaps. A third band of adhesive may be used to hold the fourth flap in position and provide additional sealing qualities.

5 Claims, 7 Drawing Figures

CARTON SEALING

BACKGROUND OF THE INVENTION

1. Field of the Invention

This invention relates to closures for paperboard cartons and more particularly to means for providing a tight seal in the closure to prevent the contents thereof from sifting out through the seams.

2. Description of the Prior Art

Paperboard cartons are an inexpensive and convenient method for storage, shipment and display of almost any type of article. Where the contents of the carton, however, are to be finely divided, such as powders, granulated materials, or any small particulate matter such as seeds, it is necessary that the end closures of the carton be tightly sealable. This seal is necessary not only to keep the contents from sifting out through the seams, but to prevent insects from attaining entry into the box. A common method of overcoming these problems is to provide the carton with a bag enclosure within the carton or a tight paper overwrap label over an unprinted paperboard package. This, of course, adds to the complexity of the equipment, the cost of the packaging, as well as the shipping weight.

Embossing the end flaps so that they lie in closer relationship is also common, as described in U.S. Pat. No. 3,003,677 which is assigned to the assignee of the present application. None of these solutions is entirely desirable nor completely satisfactory in its operation.

SUMMARY OF THE INVENTION

A configuration of bands of adhesive applied to the end flaps of a paperboard carton where two of the end flaps in opposed relationship substantially cover the area of the end of the carton. One of these flaps is folded into position with the other flaps outwardly opened and two bands of adhesive are placed along each side of this first folded flap and onto the adjacent secondary flaps which are then folded into position creating a tight seal over which the second large flap is folded which may have a band of adhesive placed thereon to give even further protection.

DETAILED DESCRIPTION OF THE PREFERRED EMBODIMENT

Figure 2:
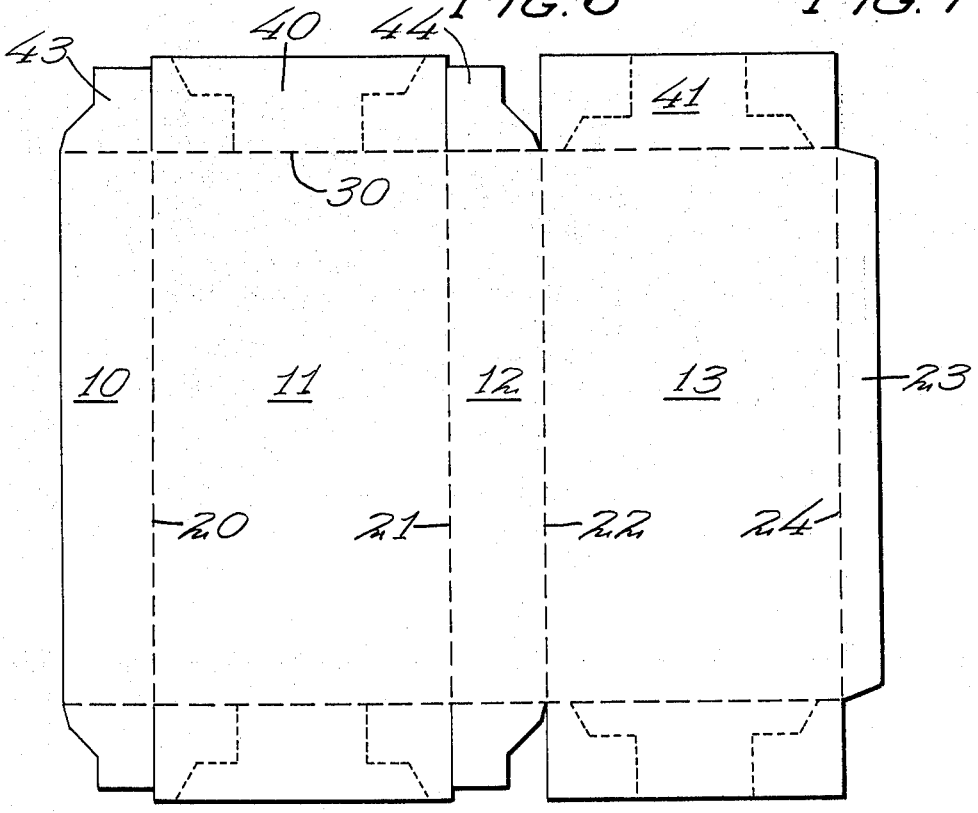
FIG. 2 is a blank shown in plan view which is adapted to be folded into a carton having an end closure which may be adaptable to use with the present invention.

This invention has particular application to those cartons which will be used for containing powders or other finely divided material which have a tendency to sift out through the crevices between the end closure flaps in a conventional carton closure. Cartons designed to contain this type of material generally have at least two flaps which are formed in size an amount substantially equal to the cross sectional area of the end of the carton. The blank in FIG. 2 is for a standard rectangular wrap-around style carton having four side panels adapted to be connected in rectangular common tubular relation. The blank is made from a substantially rectangular sheet of foldable paperboard or similar sheet-like material and has four side panels 10, 11, 12 and 13 defined by three parallel fold lines 20, 21 and 22. The particular blank as shown has a manufacturer's joint flap 23 connected along one edge by a fourth fold line 24. For convenience only one end of the carton will be detailed and as can be seen at the top of the blank there are four closure flaps hingedly attached to the adjacent panels along a hinge line perpendicular to the first mentioned fold lines and designated as 30. The closure flaps are formed so that they will be in opposed relationship in the folded configuration of the container, and two of these opposed flaps, 40 and 41 are attached to the side panels 11 and 13 respectively and are formed in height substantially equal to the width of the opposed side panels 10 and 12, so that in folded relationship they will cover substantially the entire surface area of the end of the carton. The remaining two flaps 43 and 44 are hingedly attached to the side panels 10 and 12 and in the particular configuration shown are not of such a size as to cover the entire end of the carton. When the opposing side panels are substantially different in width as in the blank of FIG. 2, to have these remaining flaps sized at about the same height as the flaps 40 and 41 facilitates manufacture thereof, but if a carton is designed which is substantially square in cross section then it becomes more feasible to have all four closure flaps substantially equal to the open end area of the carton.

As can be seen in the Figures, the particular carton shown has end flaps embossed to permit them to lie in closer relationship than standard flaps, such as described in the U.S. Pat. No. 3,003,677 issued Oct. 10, 1961. The necessity for embossing these flaps depends in large part on the thickness of the paperboard to be used as well as the particle size of the material to be contained within the carton. The dashed lines and the opposed flaps 40 and 41 in FIG. 2 are intended to represent the borders of the embossed areas and are seen better in FIGS. 1 and 3.

Figure 1:
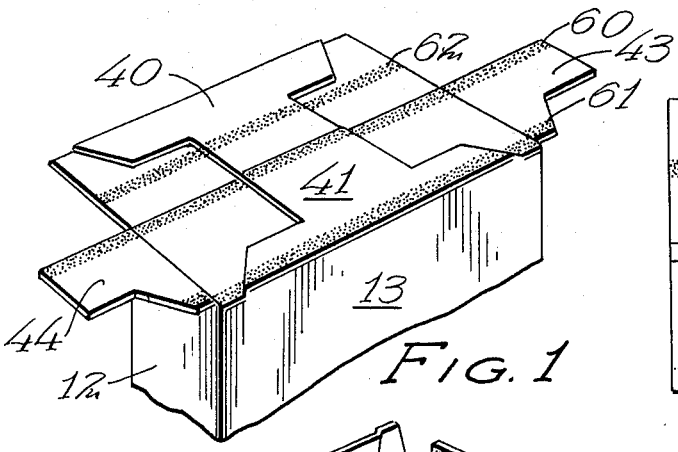
FIG. 1 is a perspective view of a carton having an end closure embodying the present invention shown in perspective with one side flap folded into position and the adhesive bands applied thereto prior to folding the other flaps.

FIG. 1 shows the opposed carton panels 10, 11, 12 and 13 in folded tubular relationship and illustrates the appropriate position of the flaps when the adhesive is to be applied. One of the two opposed flaps 40 and 41 which substantially cover the end of the carton is folded inwardly to cover the end of the carton and the remaining flaps are opened outwardly into the same plane exposing their inwardly foldable surfaces. In FIG. 1 flap 41 is shown folded inwardly first since it is embossed to accommodate the remaining flaps 43 and 44 on its outer surface, but if no embossing is used then either flaps 41 or 40 may be folded first. The reason for having the flaps in this position is that the bands of adhesive shown as 60, 61 and 62 may be applied in straight lines by using conventional equipment for dispensing adhesive and may be dispensed by moving the carton linearly underneath the equipment. The adhesive used may be any of those well known in the art including cold resin and hot-melt types. The first band of adhesive 60 is dispensed along the outer edge of the first folded flap 41 juxtaposed with the hinge line of the second opposed flap 40 and is spread in a continuous band onto the adjacent areas of the remaining flaps 43 and 44. The purpose of this band of adhesive is to seal the opening along that edge where the first flap 41 meets the hinge line 30 at the top of the side panel 11. The second continuous band of adhesive is applied along the opposite edge of the first folded panel 41 along the hinge line which connects flap 41 to the side panel 13. The band is likewise extended onto the adjacent areas of the remaining flaps 43 and 44.

Figure 3:
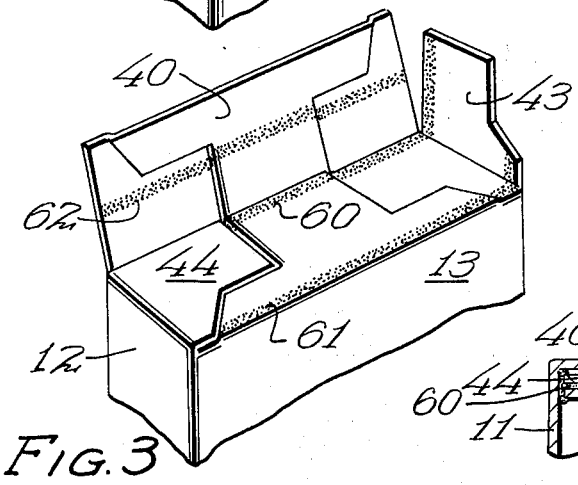
FIG. 3 is a perspective view of an end of a carton similar to that shown in FIG. 1 with one of the secondary flaps folded into position.

It can be seen in FIG. 3 that the remaining flaps 43 and 44 are folded inwardly and a complete seal results around the top of the carton by virtue of the two bands of adhesive 60 and 61 which extend the length of the side panels 11 and 13 and which, because the remaining flaps 43 and 44 are folded inwardly plug up the joint or crack which results in the corner and also where the hinge line 30 joins the two flaps 43 and 44 to the side panels 10 and 12 of the carton. The second opposed flap 40 may be folded downward and attached by conventional means, but additional sealing properties and closure rigidity will be obtained if the third band of adhesive 62 is applied along the inwardly foldable surface of the second flap 40 in such a position that in its final folded position the third band of adhesive 62 will be located between the first and second bands of adhesive 60 and 61.

Figure 4:
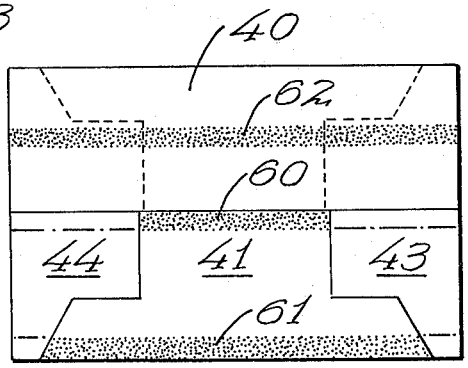
FIG. 4 is a top plan view of the carton closure shown in FIG. 1 with the secondary flaps folded in position and the fourth flap yet open.
Figure 5:
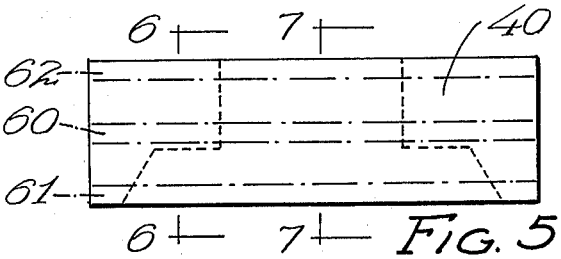
FIG. 5 is a top plan view of the carton closure shown in FIGS. 1, 3 and 4 with the flaps in final folded position.

FIGS. 4 and 5 illustrate a plan view of the carton shown in FIG. 3 after the two flaps 43 and 44 are in folded position but with the second folded flap 40 in the outward position. FIG. 5 as previously mentioned shows a plan view of the final folded container with only the outward flap 40 visible and the three bands of adhesive 60, 61 and 62 shown in dash lines, illustrating how the third band of adhesive 62 in the final folded position lies between the first two bands 60 and 61.

Figure 6:
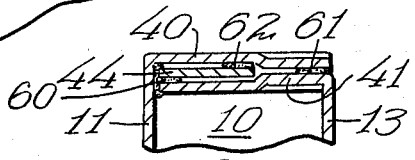
FIG. 6 is a side elevational section view of a portion of the closure shown in FIG. 5 taken along section lines 6—6.
Figure 7:
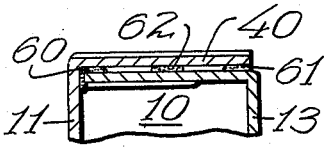
FIG. 7 is a side elevational section view taken along section line 7—7 in FIG. 5.

FIGS. 6 and 7 are two views through the sections indicated in FIG. 5 which help to illustrate how the present invention provides adequate sealing of the carton. FIG. 6 shows how the adhesive band 60 squeezes to completely seal off the crack resulting when the flap 41 is folded down and shows how in the corner of the carton the double thickness of adhesive which results when flap 44 is folded inwardly provides even more adhesive to form a bead which completely seals any openings to prevent sifting of the material contents from within the carton. Likewise the bands of adhesive 61 and 60 seal off the crevices, and in the particular configuration shown, in which the remaining flaps 43 and 44 do not extend completely to the midpoint of the carton, the two bands of adhesive 60 and 61 also help to seal the second opposed flap 40 into position on top of the earlier folded flaps. FIG. 6 differs from FIG. 7 in that it is taken through a section where there is embossing to accommodate the remaining flap 44 between the two larger opposed flaps 40 and 41. FIG. 7, on the other hand, is a section through the center showing only the relationship of the two opposed flaps 40 and 41.

In accordance with the Patent Statutes, I have described the principles of construction and operation of my improvement in CARTON SEALING; and while I have endeavored to set forth the best embodiment thereof, I desire to have it understood that obvious changes may be made within the scope of the following claims without departing from the spirit of my invention.

We claim:

1. A carton closure for an end of a carton made from foldable paperboard or the like having four, rectangularly arranged side panels, comprising:

a first folded flap substantially covering said end of said carton hingedly attached to a first of said side panels along a hinge line;

a pair of opposed secondary flaps hingedly connected to the side panels at right angles to said first panel, said secondary flaps positioned in overlapping relationship to said first folded flap;

a first continuous band of adhesive extending across the length of said first folded flap along said hinge line, said first adhesive band located between said first flap and said secondary flaps;

a second line of adhesive extending across the length of said first folded flap juxtaposed along the edge of said flap furthest from said hinge line, said second band of adhesive located between said first flap and said secondary flaps; and a fourth flap hingedly attached to the side panel opposite said first panel and located in overlapping relationship to said first folded and secondary flaps, said fourth flap covering substantially all of said end of said carton.

2. The carton closure of claim 1 including a third band of adhesive located between said first and second bands and directly beneath said fourth flap.

3. The carton closure of claim 1 wherein said adhesive is a cold wet resin adhesive.

4. The carton closure of claim 1 wherein said adhesive is a hotmelt adhesive.

5. The carton closure of claim 1 wherein those portions of said first adhesive band located between said first flap and said secondary flaps are of increased thickness and width, said increase resulting from folding said secondary flaps into contact with said first folded flap, said first folded flap and said secondary flaps having had applied thereto said first continuous band of adhesive in a straight line perpendicular to the fold lines connecting said secondary flaps to said side panels adjacent to said secondary flaps.

* * * * *